United States Patent [19]

Bridger et al.

[11] 4,090,953

[45] May 23, 1978

[54] PROCESS FOR UPGRADING LUBRICATING OIL STOCK

[75] Inventors: Robert F. Bridger, Hopewell; Costandi A. Audeh; El-Ahmadi I. Heiba, both of Princeton, all of N.J.

[73] Assignee: Mobil Oil Corporation, New York, N.Y.

[21] Appl. No.: 694,003

[22] Filed: Jun. 8, 1976

[51] Int. Cl.[2] ..... C10G 29/04; C10G 29/10; C10G 29/16

[52] U.S. Cl. ..... 208/177; 208/288; 208/295; 208/296; 208/297; 208/299

[58] Field of Search ..... 208/208 R, 216, 243, 208/244, 247, 293, 288, 177, 295, 296, 299; 252/31

[56] References Cited

U.S. PATENT DOCUMENTS

| | | | |
|---|---|---|---|
| 1,795,278 | 3/1931 | Fischer | 208/208 R |
| 2,854,399 | 9/1958 | Weller | 208/293 |
| 2,985,586 | 5/1961 | Willson et al. | 208/216 |
| 3,904,511 | 9/1975 | Heiba et al. | 208/288 |
| 3,917,566 | 11/1975 | Scott et al. | 208/293 |

*Primary Examiner*—George Crasanakis

*Attorney, Agent, or Firm*—Charles A. Huggett; Raymond W. Barclay; Dennis P. Santini

[57] ABSTRACT

An improved process for preparing a stabilized lubricating oil resistant to oxidation and sludge formation upon exposure to a highly oxidative environment, such as when metals are present and an overbased component is present in the lubricating oil, is provided. In the present process wherein a lubricating oil stock to be upgraded is contacted with elemental sulfur in the presence of a catalyst material selected from the group consisting of alumina, aluminosilicate, a metal of Groups II-A, II-B, VI-B or VIII of the Periodic Table of Elements, an oxide of a metal of Groups II-A, II-B, VI-B or VIII, a sulfide of a metal of Groups II-A, II-B, VI-B or VIII, clay, silica, silica combined with an oxide of a metal of Groups II-A, III-A, IV-B or V-B, and combinations thereof, at relatively low temperatures of from about 150° to about 225° C, an improvement is provided which comprises conducting said contacting in a flow reactor or under conditions comparable to those existing in a flow reactor at a liquid hourly space velocity of from about 0.5 $hr^{-1}$ to about 20 $hr^{-1}$ whereby the amount of elemental sulfur required to provide a stabilized lubricating oil stock is significantly lower than when a batch reactor is utilized, thus facilitating subsequent removal of excess unreacted sulfur.

6 Claims, No Drawings

PROCESS FOR UPGRADING LUBRICATING OIL STOCK

BACKGROUND OF THE INVENTION

1. Field of the Invention

This invention relates to the production of improved lubricating oils. In particular, it relates to an improved method of preparation of stable lubricating oils which are highly resistant to oxidation and sludge formation when exposed to a highly oxidative environment.

2. Description of Prior Art

Hydrocarbon lubricating oils have been obtained by a variety of processes in which high boiling fractions are contacted with hydrogen in the presence of hydrogenation-dehydrogenation catalysts at elevated temperatures and pressures. In such processes there is a consumption of hydrogen. Lubricating oil fractions are separated from the resulting products. Such lubricating oil fractions differ from those obtained by fractional distillation of crude oils and the like, since they have such relatively high viscosity index values that solvent extraction treatments are generally not required to enhance their viscosity index values. Such lubricating oil fractions suffer from the shortcoming that they are unstable when exposed to highly oxidative environments. When so exposed, sediment and lacquer formation occurs, thus lessening the commercial value of such lubricants.

Methods in the art directed to lessening such a shortcoming are exemplified by U.S. Pat. Nos. 3,436,334 and 3,530,061. They teach making a lubricating oil product fraction of hydrocracking resistant to deterioration upon exposure to light and air by contacting the lubricating oil fraction with a solid contacting agent having hydrogenation-dehydrogenation properties under hydrogen pressure (U.S. Pat. No. 3,530,061); and making hydrocarbon lubricating oil resistant to such deterioration by contacting high boiling hydrocarbons with a hydrogenation-dehydrogenation catalyst and hydrogen (with hydrogen consumption), and thereafter dehydrogenating the resultant product on contact with a metal oxide or with metal and oxygen (U.S. Pat. No. 3,436,334). Both methods employ hydrogen atmosphere, high pressure and high temperature, i.e. 500° to 1000° F. No sulfur is employed in either patent method.

U.S. Pat. No. 3,904,511 teaches a batch operation process for stabilization of a lubricating oil stock which comprises contacting a high boiling hydrocarbon fraction lubricating oil stock with elemental sulfur in amount of from 0.2 to 1.0 percent by weight of the oil stock in the presence of a catalyst.

The present invention is directed to an improved process and means for effecting substantial improvement in oxidative properties of lubricating oil by a low pressure, relatively low temperature partial dehydrogenation mechanism in the presence of a small amount of elemental sulfur, e.g. 0.025 to 0.2 weight percent, and a catalyst.

U.S. Pat. No. 2,604,438 teaches a "hydroforming" process for catalytic dehydrogenation of light (i.e. boiling at less than 600° F) hydrocarbon oils, presumably to increase aromatic content. The patent discloses the known fact that in processes of that nature, the presence of a small amount of sulfur in the feed has a beneficial effect. It further states that when the oil to be "hydroformed" has no sulfur, i.e. no sulfur in the light hydrocarbon feed, then a small amount of sulfur, e.g. a reducible sulfur compound, is added to the feed. The patent emphasizes that the invention disclosed therein "is only advantageous when the process is carried out at a temperature conducive to dehydrogeneration, i.e. at a temperature of at least 825° F." Proclaimed in the patent is the fact that when lower temperatures are used, e.g. 150° to 225° C as in the present invention, "the described method offers no advantage."

The prior art practices of hydrofinishing and hydrotreating as a means of treatment of lubricating oil stocks (i.e. stocks boiling at temperatures over 600° F) leave behind the unstable oil fractions, i.e. hydroaromatic compounds, with labile hydrogen atoms such as, for example, fluorenes, benzofluorenes, acenaphthenes, tetralin, fused cycloalkylaromatics and naphthenes, which are quite unstable toward oxygen, particularly in the presence of metals in lubricating oil formulations containing overbased additives. These hydroaromatic compounds with labile hydrogen atoms are known to be present in small quantities in conventionally furfural refined stocks and can lead to oxidative instability of any lubricant containing them. Further, it is well known that the sensitivity of certain lubricating oils toward alkaline additives can cause oxidative degradation in applications where overbased additives are used, such as automotive and diesel lubricants. Also, metal sensitivity can be quite detrimental to the oxidative stability of lubricants or functional fluids in applications such as turbine circulating oils, steam turbine oils and hydraulic fluids. No method is known at present which so effectively and easily alleviates the above problems as the present invention.

SUMMARY OF THE INVENTION

In accordance with the present invention there is provided an improved process and means for forming lubricating oils which are highly resistant to deterioration, e.g. oxidation and sludge formation, upon exposure to a highly oxidative environment.

The process of the present invention comprises contacting a lubricating oil stock, such as, for example, from a Midcontinental U.S.A. crude or an Arabian Light crude, in a flow reactor or under conditions comparable to those existing in a flow reactor with elemental sulfur in amount of from about 0.025 to about 0.2 percent by weight of the oil stock in the presence of a catalyst material selected from the group consisting of alumina, silica, an aluminosilicate, a metal of Groups II-A, II-B, VI-B or VIII of the Periodic Table of Elements, an oxide of a metal of Groups II-A, II-B, VI-B, or VIII, a sulfide of a metal of Groups II-A, II-B, VI-B or VIII, clay, silica combined with an oxide of a metal of Groups II-A, III-A, IV-B or V-B and combinations thereof.

The elemental sulfur for use herein may be provided for the treatment, if desired, by a sulfur precursor, such as, for example, $H_2S$, an organosulfur compound, i.e. added or naturally occurring, or combinations thereof. Said naturally occurring organosulfur compound may be utilized if present in the lubricating oil stock in a quantity providing greater than about 0.125 weight percent sulfur. When such an organosulfur compound is the source of elemental sulfur herein, it can serve for generation of sulfur in situ. The catalyst materials for use in this invention serve to assist the extrusion of naturally occurring sulfur from the lubricating oil stock and, if sufficient organosulfur compounds are present therein, dehydrogenation is enhanced.

Non-limiting examples of sulfur precursors which may be utilized in the present process include $H_2S$, RSH, $RS_xH$, $HS_xH$, and $RS_xR$, wherein R is a hydrocarbyl group and $x$ is an integer of from 1 to 4 or more. Under actual operating conditions as herein set forth, these sulfur precursors, if used, can interact with the catalyst material for use herein to serve as a source of active sulfur in situ.

The treatment in accordance with the present invention may be followed, if desired, with various well known treatments such as thermal treatment or oxidation treatment in the presence of atmospheric oxygen and transition metal ions.

DESCRIPTION OF SPECIFIC EMBODIMENTS

The lubricating oil stocks which may be treated in accordance with the present invention may generally be any high boiling range materials boiling above about 600° F. Such lubricating oil stock materials include those obtained by fractionation, as by, for example, vacuum distillation, of crude oils identified by their source, i.e. Pennsylvania, Midcontinent, Gulf Coast, West Texas, Amal, Kuwait, Barco and Arabian. Said oil stock materials include one having a substantial part thereof of the fractionation product of the above crude oils mixed with other oil stocks.

The catalyst materials employed herein can include any type of catalyst which will bring about partial dehydrogenation and sulfur labilization (or sulfurization-desulfurization) when applied to the lubricating oil stock in the presence of elemental sulfur in very small quantity and at low operating temperature in an unpressured flow system. Such catalyst materials are known in the art for use in various other catalytic processes and include alumina, silica, silica combined with an oxide of a metal of Groups II-A, III-A, IV-B or V-B of the Periodic Table of Elements, such as, for example, silica-alumina, an aluminosilicate, a metal of Groups II-A, II-B, VI-B or VIII such as, for example, Mg, Ca, Zn, Cr, Mo, Fe, Co, Ni or Pt, an oxide of a metal of Groups II-A, II-B, VI-B or VIII such as CaO, MgO, $Fe_2O_3$, $MnO_2$, $Cr_2O_3$ or ZnO, a sulfide of a metal of Groups II-A, II-B, VI-B or VIII such as, for example, $Fe_2S$, $Fe_2S_3$, $FeS_2$, (either marcasite or pyrite) or $Fe_7S_8$ (pyrrhotite), certain clay and combinations thereof.

Non-limiting examples of the clays which may be useful as the catalyst material in the process of this invention include the montmorillonite and kaoline families, which families include the sub-bentonites and the kaolins commonly known as Dixie, McNammee, Georgia and Florida clays, or others in which the main mineral constituent is halloysite, kaoline, dickite, nacrite, attapulgite or anauxite. Such clays can be used in the raw state as mined or initially subjected to calcination, acid treatment or chemical modifications.

Non-limiting examples of siliceous materials useful as the catalyst in the present invention include silica and combinations thereof with oxides of metals of Groups II-A, III-A, IV-B and V-B, such as, for example, silica-alumina, silica-magnesia, silica-zirconia, silica-thoria, silica-beryllia, silica-titania, as well as thernary compositions of silica, such as, for example, silica-alumina-thoria and silica-alumina-zirconia.

Non-limiting examples of aluminosilicate materials which may be useful as the catalyst herein include the synthetic zeolites A, B, L, T, X, Y, ZK-4, ZK-5, ZSM-4, ZSM-5, ZSM-35, ZSM-38 and others, and the natural zeolites levynite, dachiartie, erionite, faujasite, analcite, paulingite, noselite, phillipsite, chabazite, leucite, mordenite and others.

The catalyst loses some of its activity during use and, therefore, may be regenerated. The spent catalyst is contacted with a free oxygen-containing atmosphere at an elevated temperature sufficient to burn carbonaceous deposits from the catalyst. Conditions for regenerating the catalyst include a temperature between about 600° and 1,000° F, a pressure of from atmosphereic to about 500 pounds per square inch, a total gas flow rate of from about 1 to about 20 volumes per volume of catalyst per minute and an oxygen concentration of from about 0.1 percent to 100 percent. The oxygen can be diluted with steam, nitrogen or other inert gas.

The process of the present invention involves the partial incorporation of sulfur into the lubricating oil stock or the partial desulfurization of the oil stock in addition to the partial dehydrogenation of the oil stock. Said dehydrogenation is believed to involve oxidatively unstable fractions of said oil stock including, for example, the above mentioned hydroaromatics such as fluorenes, benzofluorenes, acenaphthenes, tetralin, fused cycloalkylaromatics, naphthenes and the like. The unstable hydrogen of said hydroaromatics is eliminated from the oil stock treated in accordance herewith as one or more of the forms $H_2S$, RSH, $HS_xH$ and $RS_xR$, wherein R is a hydrocarbyl group and $x$ is an integer ranging from 1 to about 4 or more.

The elemental sulfur employed in the process of the present invention may be in any of several allotropic forms such as $S_6$, $S_8$ or polymeric sulfur and may be used in very small amounts of from about 0.025 to about 0.2 percent by weight of oil stock, with a preferable range of from about 0.05 to about 0.15 percent by weight. It is readily observable that this invention differs from the well-known method of making sulfurized oil-extreme pressure agents in conditions of processing, the concept of improvement, the amount and type of sulfur incorporated and the chemical modification of the oil stock itself. In the present invention, small amounts of stable sulfur may be chemically incorporated into the oil molecules as labile hydrogen atoms are removed. On the other hand, in sulfurized oils used as extreme pressure agents, large quantities of sulfur, such as, for example, 10 to 15 percent by weight, are incorporated, including a substantial quantity of elemental sulfur as such.

If desired in the present process, and specifically if desired when the lubricating oil stock being treated in accordance herewith contains substantial naturally occurring organosulfur compounds such that the sulfur content of the oil is greater than about 0.125 weight percent, a low partial pressure of hydrogen may be applied to the catalyst-oil system of from about 15 to about 250 psig. The sulfur in such an embodiment of the present invention is provided in situ as hereinbefore described and the lubricating oil product is substantially improved in stability properties.

In practice of the present invention, a base or base precursor may be used as a secondary agent in combination with the catalyst as above defined. Non-limiting examples of such secondary agents include lithium hydroxide, potassium hydroxide, potassium acetate, sodium hydroxide, sodium acetate and sodium carbonate. Such a combination of catalyst material and secondary agent promotes the fixing of sulfur and/or the dehydrogenation of labile hydrogen atoms.

The operating parameters in the present flow reactor process are critical to achieving the desired result of degree of improvement or upgrading product quality of the lubricating oil stock treated without loss in yield. Aside from specific small amounts of sulfur, the reaction temperature must be within the range of from about 150° to about 225° C, preferably from about 160° to about 180° C. The reaction pressure may be from about 0 psig to about 500 psig, preferably from about 0 psig to about 200 psig. Liquid hourly space velocity (LHSV) must be maintained within the range of from about 0.5 to about 20 $hr^{-1}$ (vol. oil/vol. catalyst), preferably from about 1 to about 10 $hr^{-1}$ and more preferably from about 1 to about 5 $hr^{-1}$.

By using the improved flow process of the present invention, a smaller concentration of elemental sulfur is required than if a batch process, e.g. U.S. Pat. No. 3,904,511, is used. When the batch process is used, there is needed from about 0.2 to about 1.0 percent by weight of the oil stock being treated of elemental sulfur. When the present flow process is used, i.e. a flow reactor or conditions comparable to those existing in a flow reactor, only from about 0.025 to about 0.2 percent by weight of the oil stock being treated of elemental sulfur is needed. Economic and processing benefits from the present process when compared to those of the prior art are readily noted. One such benefit is, of course, that removal of excess unreacted sulfur from the oil stock treated hereby is greatly facilitated. Further, corrosion problems inherent in the use of larger amounts of sulfur are solved.

In order to more fully illustrate the process of the present invention, the following specific examples, which in no sense limit the invention, are presented. The basic test procedure employed in evaluation of product yield from the present process is described by Dornte in *Industrial and Engineering Chemistry,* 28, 26–30, 1936 modified as below indicated.

It is interesting to note that performance of a lubricating oil in the below described test method is indicative of that oil's performance in the field. The test is conducted in an air circulation apparatus of the type described by Dornte. A tube containing 30 grams of lubricating oil (with or without additive) is placed in a heater thermostatted at 162° C. Air is circulated through the oil sample at a rate of 5 liters per hour. Metal surfaces are provided for oil contact to act as oxidation accelerators. The metal surfaces employed include: iron wire, analytical grade, Washburn and Moen No. 15 gage, wound into a coil approximately $\frac{5}{8}$ inch O.D. and $2\frac{5}{8}$ inches long to give a surface area of approximately 15.3 square inches; copper wire, electrolytic, B and S gage No. 18, 6.2 inches long; and a lead (tin-free) square 0.25 inch × 0.25 inch cut from 1/16 inch thick sheet.

Another test method used herein is the standard Rotary Bomb Oxidation Test (RBOT) designated ASTM D2272. Each sample tested in the RBOT test was blended with a standard commercial additive package prior to testing.

The lubricating oil stock used in the following examples was conventionally refined by distillation, followed by furfural extraction and methyl ethyl ketone dewaxing. It is identified in Table 1 according to source, physical properties and furfural extraction conditions.

TABLE 1

CRUDE SOURCE AND NOMINAL VISCOSITY OF LUBRICATING OIL STOCK USED HEREIN

| | 150 S.U.S. Arabian Light |
|---|---|
| Furfural Dosage, % volume | 180 |
| Tower Temp., ° F, Top | 185 |
| Tower Temp., ° F, Bottom | 140 |
| Gravity, ° API | 30.9 |
| Pour Pt., ° F | 0 |
| Flash Pt., ° F | 410 |
| Sulfur, % wt. | 0.63 |
| Nitrogen, % wt. | 0.0029 |
| Aniline Point, ° F | 210 |
| Viscosity, S.U.S. at 100° F | 152 |
| Viscosity Index | 103 |
| ASTM Color | 1½ |

EXAMPLE 1

A 50 gram quantity of the above oil stock, without treatment in accordance with the present invention, was subjected to the RBOT test and a 30 gram quantity of the untreated oil was subjected to the above-described Dornte test. The results of the tests are recorded in Table 2 for comparison purposes with tests conducted on the same oil stock treated by the present process (Examples 2–5).

EXAMPLE 2

A 450 gram quantity of the above oil stock was mixed with 0.2 weight percent of elemental sulfur (based on weight of oil) and allowed to flow through a reactor containing 10 grams of 1/16-inch extrudate zeolite X (i.e. NaX). The reaction temperature was maintained at 175° C, the reaction pressure was maintained at 25 psig and the LHSV was 1 $hr^{-1}$. The oil was then cooled to room temperature and residual corrosive sulfur was removed by stirring the oil with finely divided sodium hydroxide (50 grams) for 16 hours. After removal of the sodium hydroxide by filtration, the oil was tested in the RBOT and Dornte tests, and shown to have improved oxidation properties, as demonstrated in Table 2.

The flow reactor used was a 15 ml. downflow reactor.

EXAMPLE 3

A 450 gram quantity of the above oil stock was mixed with 0.1 weight percent of elemental sulfur (based on weight of oil) and allowed to flow through the reactor and under the reaction conditions of Example 2. The oil was then washed with sodium hydroxide, filtered and tested as in Example 2. The results, showing improved oxidation properties, are recorded in Table 2.

EXAMPLE 4

A 450 gram quantity of the above oil stock was mixed with 0.05 weight percent of elemental sulfur (based on weight of oil) and allowed to flow through the reactor and under the reaction conditions of Example 2. The oil was then washed with sodium hydroxide, filtered and tested as in Example 2. The results, showing improved oxidation properties, are recorded in Table 2.

EXAMPLE 5

A 450 gram quantity of the above oil stock was mixed with 0.025 weight percent of elemental sulfur (based on weight of oil) and allowed to flow through the reactor and under the reaction conditions of Example 2. The oil was then washed with sodium hydroxide, filtered and tested as in Example 2. The results, showing improved oxidation properties, are recorded in Table 2.

EXAMPLE 6

In order to demonstrate the beneficial effect of the present flow process over that of the art whereby the sulfur contacting is conducted in a stirred batch reactor (i.e. as in U.S. Pat. No. 3,904,511), a 450 gram quantity of the above oil stock was thermostatted under nitrogen at 175° C in the presence of 10 grams of the zeolite catalyst used in above Examples 2–5. Elemental sulfur (2.25 grams) was added and the oil was stirred at 175° C for 1 hour while hydrogen sulfide was evolved. The oil was cooled to room temperture and residual corrosive sulfur was removed by stirring the oil with finely divided sodium hydroxide as in Examples 2–5. The product was filtered and tested as in Examples 2–5 and the results of the tests are recorded in Table 2.

EXAMPLE 7

Further in demonstration of the beneficial effect of the present flow process over that of the art whereby the sulfur contacting is conducted in a stirred batch reactor (i.e. as in U.S. Pat. No. 3,904,511), a 450 gram quantity of the above oil stock is thermostatted under nitrogen at 175° C in the presence of 10 grams of the zeolite catalyst used in above Examples 2–5. Elemental sulfur (0.45 grams) is added and the oil is stirred at 175° C for 1 hour while hydrogen sulfide is evolved. The oil is cooled to room temperature and residual corrosive sulfur is removed by stirring the oil with finely divided sodium hydroxide as in Examples 2–5. The product is filtered and tested as in Examples 2–5 and the results of the tests are recorded in Table 2.

TABLE 2

Oxidation Test Results of Examples 1–7

| Example | RBOT, minutes | | Dornte, hours* | |
|---|---|---|---|---|
| 1 | 268 | | 43.3 | |
| 2 | 360 | | 86.3 | |
| 2 (repeated) | — | | 90.9 | |
| 3 | 395 | average 394 | 59.5 | average 75.8 |
| 4 | 400 | | 79.0 | |
| 5 | 420 | | 63.4 | |
| 6 | 343 | | 65.2 | |
| 6 (repeated) | 345 | average 329 | 77.3 | average 62.5 |
| 7 | 300 | | 45.1 | |

*Time required for absorption of 1 mole $O_2$ per kg oil at 162° C with Fe, Cu and Pb present.

EXAMPLE 8

In the flow reactor of Example 2 containing 15 ml. of 1/16-inch extrudate zeolite X, i.e. NaX, and with the temperature maintained at 175° C, the pressure at 25 psig and the LHSV at 1 $hr^{-1}$, the above oil stock was contacted with elemental sulfur in four different concentrations varied wth time on stream to examine degree of dehydrogenation of the oil stock. The initial contacting was at 0.2 weight percent elemental sulfur (based on weight of oil). At 113 hours on stream, the contacting was changed to 0.1 weight percent elemental sulfur. At 141 hours on stream, the contacting was changed to 0.05 weight percent elemental sulfur and at 168 hours, to 0.025 weight percent elemental sulfur. Results indicated that stable oil can be produced at much lower degrees of reaction then previously suspected since good oxidation stabilities (see Table 2) were obtained in the range of only 0.028 to 0.17 mole percent of oil reacted (see results of Example 8 in Table 3).

TABLE 3

Dehydrogenation of Lubricating Oil Stock in Example 8

| Hours on Stream | % S* | % $H_2S$** | % S Converted | Oil Stock Converted, mole percent*** |
|---|---|---|---|---|
| 0 – 113 | 0.2 | 0.0145 | 7.25 | 0.17 |
| 113 – 141 | 0.1 | 0.0054 | 5.40 | 0.063 |
| 141 – 168 | 0.05 | 0.0039 | 7.80 | 0.046 |
| 168 – 193 | 0.025 | 0.0024 | 9.60 | 0.028 |

*Weight percent of elemental sulfur contacted with the oil stock in the flow reactor.
**Weight percent of $H_2S$ formed in the oil stock.
***Assuming a molecular weight of oil stock at 400, this value is 100 × moles $H_2S$/mole of oil.

EXAMPLES 9–12

These examples were conducted in the flow reactor of Example 2 containing 10 grams of 1/16-inch extrudate zeolite X (i.e. NaX). The weight percent of elemental sulfur used (basis of 450 grams oil stock identified above) and the reaction conditions were varied, as indicated in Table 4. The treated oil was washed, filtered and tested (RBOT) as in Example 2 and the results of the tests appear in Table 4.

EXAMPLE 13

A 450 gram quantity of the above oil stock is mixed with 0.2 weight percent of elemental sulfur (based on weight of oil) and allowed to flow through the reactor of Example 2 containing 10 grams 1/16-inch extrudate mordenite zeolite. The oil is then washed, filtered and tested (RBOT) as in Example 2. The reaction conditions and test results are recorded in Table 4.

EXAMPLE 14

A 450 gram quantity of the above oil stock was mixed with 0.1 weight percent of elemental sulfur and allowed to flow through the reactor of Example 2 containing 10 grams of 8–12 mesh rare earth exchanged zeolite Y. The oil was then washed, filtered and tested (RBOT) as in Example 2. The reaction conditions and test results are recorded in Table 4.

EXAMPLE 15

A 450 gram quantity of the above oil stock is mixed with 0.2 weight percent of elemental sulfur and allowed to flow through the reactor of Example 2 containing 10 grams of 8–12 mesh silica. The oil is then washed, filtered and tested (RBOT) as in Example 2. The reaction conditions and test results are recorded in Table 4.

EXAMPLE 16

A 450 gram quantity of the above oil stock is mixed with 0.2 weight percent of elemental sulfur and allowed to flow through the reactor of Example 2 containing 10 grams of 40 mesh silica-alumina. The oil is then washed, filtered and tested (RBOT) as in Example 2. The reaction conditions and test results are recorded in Table 4.

TABLE 4

Reaction Conditions and Oxidation Test Results of Examples 9–16

| Ex. | S* wt. % | Temp. °C | Pressure psig. | LHSV, $hr^{-1}$ | RBOT, minutes |
|---|---|---|---|---|---|
| 9 | 0.1 | 160 | 25 | 1 | 360 |
| 10 | 0.05 | 175 | 25 | 5 | 400 |
| 11 | 0.025 | 175 | 50 | 10 | 420 |
| 12 | 0.15 | 180 | 25 | 7.2 | 350 |
| 13 | 0.2 | 175 | 25 | 0.5 | 345 |
| 14 | 0.1 | 175 | 25 | 1 | 347 |
| 15 | 0.2 | 225 | 500 | 1 | 330 |

TABLE 4-continued

| Reaction Conditions and Oxidation Test Results of Examples 9-16 | | | | | |
|---|---|---|---|---|---|
| Ex. | S* wt. % | Temp. °C | Pressure psig. | LHSV, $hr^{-1}$ | RBOT, minutes |
| 16 | 0.2 | 150 | 75 | 2 | 335 |

*Weight percent of elemental sulfur mixed with the oil stock which is allowed to flow through the reactor of Example 2.

In contrast with prior art results in a stirred batch reactor, it is now found that better improvement of a lubricating oil stock in oxidation stability is obtained at both lower sulfur levels and lower degress of dehydrogenation. In a stirred batch reactor, optimum sulfur concentration is about 0.5 weight percent. In the present process, optimum sulfur concentration is less then 0.2 weight percent.

At the low sulfur concentrations of the present invention, catalyst aging does not appear significant. Further, operating at lower sulfur levels will simplify removal of corrosive sulfur materials from the oil by post-treatment.

Having thus given a general description of the process and means of this invention and provided by way of examples specific embodiments thereof, it is to be understood that no undue restrictions are to be imposed by reason thereof, and minor modifications may be made thereto without departing from the scope thereof.

What is claimed is:

1. In a process for preparing a stabilized lubricating oil resistant to oxidation and sludge formation upon exposure to a highly oxidative environment which comprises contacting a hydrocarbon fraction lubricating oil stock boiling above about 600° F with added elemental sulfur, said contacting in the presence of a catalyst material selected from the group consisting of alumina, aluminosilicate, a metal of Groups II-A, II-B, VI-B or VIII of the Periodic Table of Elements, an oxide of a metal of Groups II-A, II-B, VI-B or VIII, a sulfide of a metal of Groups II-A, II-B, VI-B or VIII, clay, silica, silica combined with an oxide of a metal of Groups II-A, III-A, IV-B or V-B, and combinations thereof at a reaction temperature of from about 150° to about 225° C and a reaction pressure of from about 0 psig to about 500 psig, the improvement which comprises conducting said contacting in a flow reactor at a liquid hourly space velocity of from about 0.5 $hr^{-1}$ to about 20 $hr^{-1}$ wherein said elemental sulfur is added in an amount of from about 0.025 to about 0.2 percent by weight of said oil stock.

2. The process of claim 1 wherein said elemental sulfur is added in amount of from about 0.05 to about 0.15 percent by weight of said oil stock, said reaction temperature is from about 160° to about 180° C, said reaction pressure is from about 0 psig to about 200 psig, and said liquid hourly space velocity is from about 1 $hr^{-1}$ to about 10 $hr^{-1}$.

3. The process of claim 2 wherein said liquid hourly space velocity is from about 1 $hr^{-1}$ to about 5 $hr^{-1}$.

4. The process of claim 1 wherein said contacting is in the presence of said catalyst material in conjunction with a secondary agent selected from the group consisting of bases.

5. The process of claim 4 wherein said base is sodium hydroxide.

6. The process of claim 1 wherein said oil stock comprises at least a substantial part of one obtained by fractionation of a crude oil identified as Pennsylvania, Mid-continent, Gulf Coast, West Texas, Amal, Kuwait, Barco or Arabian.

* * * * *